United States Patent [19]

McIntosh

[11] 4,205,838

[45] Jun. 3, 1980

[54] ADJUSTABLE SAFETY STANDS FOR BARBELL PLATES

[76] Inventor: Thomas J. McIntosh, 910 Edenridge Dr., Youngstown, Ohio 44512

[21] Appl. No.: 907,205

[22] Filed: May 18, 1978

[51] Int. Cl.[2] ..... A63B 13/00

[52] U.S. Cl. ..... 272/123; 272/144

[58] Field of Search ..... 272/117–123, 272/134, 144; 248/352, 354 R, 354 P

[56] References Cited

U.S. PATENT DOCUMENTS

| | | | |
|---|---|---|---|
| 3,118,668 | 1/1964 | Callahan | 272/123 X |
| 3,342,485 | 9/1967 | Gaul | 272/144 X |
| 3,625,511 | 12/1971 | Rennemann | 272/144 X |
| 4,042,202 | 8/1977 | Molinari | 248/354 P X |

FOREIGN PATENT DOCUMENTS

| | | | |
|---|---|---|---|
| 1447999 | 6/1966 | France | 272/123 |

*Primary Examiner*—Richard J. Apley
*Attorney, Agent, or Firm*—Webster B. Harpman

[57] ABSTRACT

Adjustable safety stands for catching plates of a barbell exercising device positioned on either side of an exercising bench.

1 Claim, 2 Drawing Figures

ADJUSTABLE SAFETY STANDS FOR BARBELL PLATES

BACKGROUND OF THE INVENTION (1) Field of the Invention

This invention relates to barbell support apparatus which will permit unrestricted vertical motion of a barbell and its assembled weights or plates.

(2) Description of the Prior Art

Prior structures of this type have utilized fixed stands for holding the barbell beforeand after the lift. See for example U.S. Pat. No. 3,118,668, U.S. Pat. No. 3,342,485 and U.S. Pat. No. 3,625,511.

In U.S. Pat. No. 3,118,668 a barbell exercising device is disclosed having a fixed frame wherein the barbell is supported by its bar on the stationary frame and its limits of vertical travel are restricted.

In the present invention catch stands for the plates of a barbell are disclosed positioned below the normal vertical travel path of the barbell and the plates thereon.

In U.S. Pat. No. 3,342,485 an exercising bench is shown having elevated barbell support stands on either side thereof well above the normal vertical travel path of the barbell.

In the present invention safety stands are positioned well below the desirable travel path of the barbell and plates permitting unrestricted free movement thereof.

In U.S. Pat. No. 3,625,511 a multi-purpose exercising bench is disclosed having fixed barbell supports arranged substantially in the normal barbell travel path.

The present invention discloses movable adjustable safety stands for use with an exercising bench which in no way interferes with the vertical or horizontal travel path of the barbell or plates thereon, but will catch the plates if the barbell is dropped and thereby prevent injury to persons using the same.

SUMMARY OF THE INVENTION

Movable adjustable safety stands for use with an exercising bench comprise a pair of vertically adjustable supports located on either side of the bench having barbell plate receiving members on their upper ends and normally positioned below the usual vertical travel path of the barbell and plates thereon when in use.

DESCRIPTION OF THE PREFERRED EMBODIMENT

Figure 1:
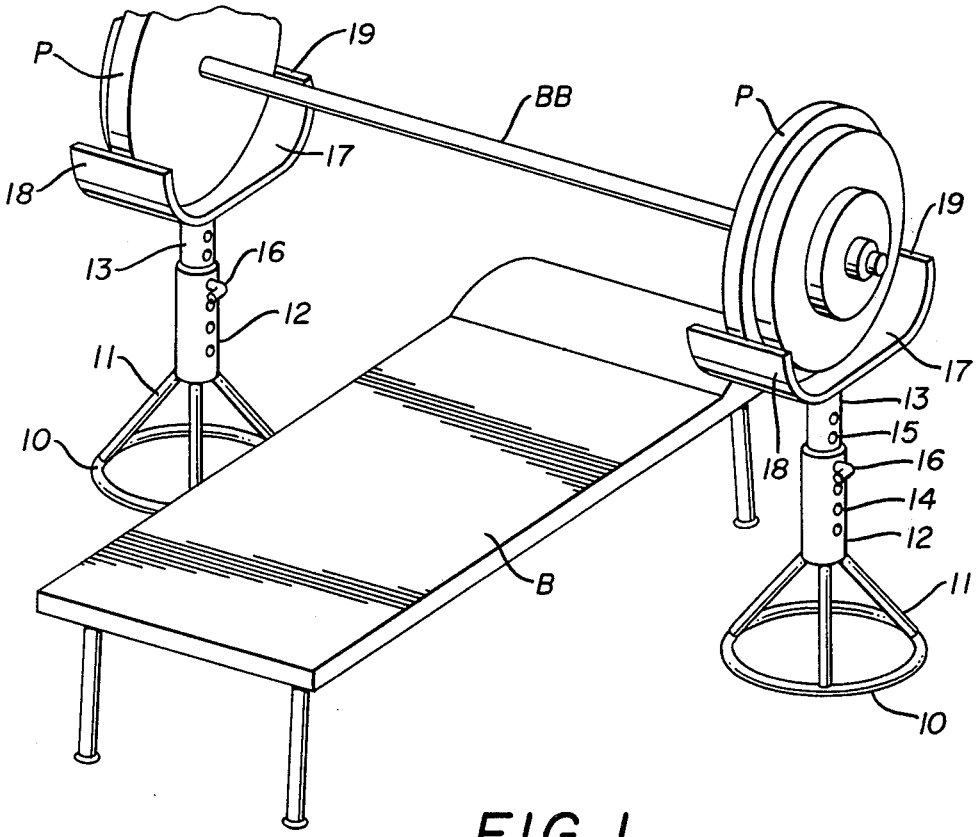
FIG. 1 is a perspective view of the movable adjusable safety stand showing a barbell and plates thereon.

By referring to FIG. 1 of the drawings, it will be seen that a pair of adjustable safety stands for receiving barbell plates are disclosed for use adjacent an exercising bench B. Each stand comprises a circular base 10 which is preferably tubular and has a plurality of circumferentially spaced upwardly and inwardly extending legs 11.

A tubular body member 12 is vertically positioned and secured to the uppermost ends of the upwardly and inwardly extending legs 11.

Figure 2:
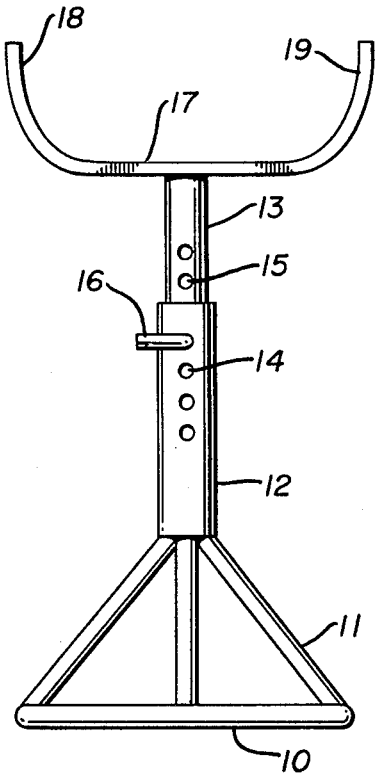
FIG. 2 is an enlarged side elevation of one of the pair of safety stands seen in FIG. 1.

A secondary tubular body member 13 is telescopically positioned partially within the tubular body member 12 (see FIG. 2). A plurality of vertically spaced apertures 14 and 15 formed in the tubular body members 12 and 13 are arranged respectively for registry in each of the tubular body members 12 and 13. A pin 16 is removably positioned through registering apertures 14 and 15 holding said tubular body members 12 and 13 in adjusted relation to each other. A body member 17 with oppositely disposed upturned ends 18 and 19 is secured to the uppermost end of the tubular body member 13 and acts to receive the plates P of a barbell BB when they are dropped.

In use the adjustable safety stands are placed on either side of an exercise bench B and positioned to receive the plates P of a barbell BB. The safety stands are then vertically adjusted to a height below the desirable travel path of the barbell BB in use by a person on the bench and set at a height where should the user lose control of the barbell BB and drop it, the safety stands will catch the plate P and prevent injury to the user.

It will be seen that the body member 17 with its oppositely disposed upturned ends 18 and 19 are of sufficient size to accommodate the largest of the plates P commonly used on barbells and will prevent them from rolling off the stands and injuring the user.

Although but one embodiment of the present invention has been illustrated and described, it will be apparent to those skilled in the art that various changes and modifications may be made therein without departing from the spirit of the invention,

Having thus described my invention what I claim is:

1. The combination of a barbell having plates of known diameter thereon, an exercising bench on which a person reclines in lifting said barbell and the plates thereon and a pair of adjustable safety stands positioned one on either side of said exercising bench, each of said safety stands comprising a circular base of a known diameter, a pair of vertically disposed telescopically engaged tubular body members, means on said base supporting said tubular body members thereabove, means for holding said tubular body members in adjustable relation to each other, a horizontally disposed elongated body member with oppositely disposed arcuate upturned ends, said elongated body member secured midway between said ends to the upper one of the uppermost of said telescopically arranged tubular body members, said horizontally disposed elongated body member being at least as long as the diameter of said circular base and of a length greater than the diameter of said plates on said barbell, and being of a width at least equal to half the diameter of said circular base and wherein said elongated body members with said arcuate upturned ends are positioned at a level slightly above the upper surface of said exercising bench.

* * * * *